United States Patent [19]

Stadlbauer, deceased et al.

[11] Patent Number: 4,985,067

[45] Date of Patent: Jan. 15, 1991

[54] PROCESS AND DEVICE FOR IMPLEMENTING HOT CHEMICAL PROCESSES

[75] Inventors: Wilhelm Stadlbauer, deceased, late of Alkoven, Austria, by Herta Stadlbauer, Wolfram Stadlbauer, Helmut Stadlbauer; Erwin Koch, Leonding, Austria; Franz Zauner, Linz, Austria; Rudolf Rinesch, Linz, Austria; Wolfgang Vanovsek, Leoben, all of Austria

[73] Assignee: K.H.T. Know-How-Trading Patent Verwetung GmbH, Vienna, Austria

[21] Appl. No.: 314,062

[22] Filed: Mar. 17, 1989

[30] Foreign Application Priority Data

May 18, 1987 [AT] Austria ..... 1258/87

[51] Int. Cl.[5] ..... H05B 7/00; C22B 4/00

[52] U.S. Cl. ..... 75/10.1; 75/10.23; 75/10.26; 75/10.34; 373/22

[58] Field of Search ..... 75/10.23, 10.1, 10.34, 75/10.26; 373/22

[56] References Cited

U.S. PATENT DOCUMENTS

| | | | |
|---|---|---|---|
| 3,565,602 | 2/1971 | Konisi | 75/10.26 |
| 3,771,585 | 11/1973 | Ulrich | 219/121 P |
| 4,033,757 | 7/1977 | Kilday | 75/68 A |
| 4,518,419 | 5/1985 | Lugscheider et al. | 373/22 |
| 4,533,385 | 8/1985 | Lugscheider et al. | 75/10.22 |
| 4,617,671 | 10/1986 | Lugscheider et al. | 373/22 |

OTHER PUBLICATIONS

Soviet Inventions Illustrated, Section E Week 7, p. 25; No. 13220 & SU, A, 825644; 10-18-78.

*Primary Examiner*—Peter D. Rosenberg
*Attorney, Agent, or Firm*—Spencer & Frank

[57] ABSTRACT

Method for melting or melt reducing chemical mixtures at temperatures which exceed the melting temperatures of highly-refractory linings. The method requires the steps of pressing the chemical mixture into bars and arranging the bars to form a cavern having a defined geometry. The cavern surrounds a centrally located high energy density radiation source. The portion of the bar facing the radiation source melts at a certain melting rate. The cavern geometry is maintained by radially advancing the bars toward the radiation source at the same rate as the melting rate.

16 Claims, 3 Drawing Sheets

II 11
2
1
4
5
7
6
3
3'
8
10

11
2
1
10
8
3'
6
7
I

IV
1
2
3
3'
4
5
6
7
8
9
10
11

1
2
3'
6
7
8
9
10
11
III

PROCESS AND DEVICE FOR IMPLEMENTING HOT CHEMICAL PROCESSES

BACKGROUND OF THE INVENTION

The present invention relates to a method and to an apparatus to carry out hot-chemical processes, in particular a melting and/or a melting-reduction of mixtures comprising foundry dusts, ores and other melting and/or melt-reducible materials, such as, e.g. $SiO_2$, MgO, $TiO_2$, $Ta_2O_5$ or the corresponding metals, at working temperatures which exceed the melting temperature of highly refractory linings.

It is not possible, using processes presently available, to carry out hot-chemical processes in temperature ranges which exceed the melting temperature of known highly refractory linings. Moreover, presently available melting and melting-reduction processes have a high energy requirement and result in substantial environmental impairment as a result of the discharge of dust contained in the waste gases, unless expensive additional installations are provided. Smelting of foundry dusts, which takes place In large quantities, also encounters considerable difficulties.

East German Patent No. 5-215 803, discloses an attempt to obtain a rapid melting-down and fast reaction between charging-stock component in s shaft furnace with a supply of electrical energy. A plasma jet is formed between a plasma torch, which is arranged centrally and which penetrates through the upper covering of the shaft furnace, and a counterelectrode, which penetrates through the floor of the shaft furnace. The charging stock is charged concentrically about the plasma jet, forming a protective dam comprising solid charging-stock components piling up on the inner wall of the furnace and the charging stock arrives in the region of the plasma jet from the inner side of the protective dam.

This procedure does not, however, permit controlled guiding of the plasma jet for the melting and/or chemical reaction of the dam formed. A continuous operation of a shaft furnace of this kind is not realizable. The waste gases resulting from the reaction must be carried away by the blast-furnace burden, thus causing further disadvantages in connection with this procedure, for instance, the condensation of waste-gas components.

SUMMARY OF THE INVENTION

It is an object of the present invention to provide a method and apparatus to carry out hot-chemical processes, in particular a melting and/or melting-reduction of mixtures comprising foundry dusts, ores and other melting and/or melt-reducible materials, such as, e.g. $SiO_2$, MgO, $TiO_2$, $Ta_2O_5$ or the corresponding metals, at temperature ranges which far exceed the melting temperature of known highly refractory linings. Simultaneously, hot-chemical physical reactions are to be controlled reliably, without necessitating a process-technological reduction of the reaction temperatures. In addition, as a substantial advantage over processes presently known, it is intended to achieve a considerable saving in energy and a prevention, as far as possible, of the discharge of dust with the waste gases.

These objects are met according to the present invention in a method of the kind mentioned at the outset, in that the mixture of defined composition, which is to be melted and/or reduced, is pressed to form bars These are arranged, to form a defined cavern geometry, about a source of radiation of high energy density, and the defined cavern geometry is maintained by means of a radial advancing of the bars of the mixture against the centrally-arranged source of radiation according to the progress of the melting and/or melting-reduction process.

DETAILED DESCRIPTION OF THE PREFERRED EMBODIMENTS

In the method according to the invention, the mixture pressed to form bars simultaneously functions as, at one and the same time, the reaction medium and the "lining" of the metallurgical reaction vessel. Depending on the melting-off rate, the bars are advanced such that the cavern geometry about the source of radiation, for example a plasma jet, is constantly maintained. To this end, the bars of the mixture are advanced radially toward the centrally-arranged source of radiation to the degree that the melting and/or melting-reduction process progresses. The plasma jet is maintained within the cavern by appropriate means, as will be set out in more detail below.

For the purposes of the precise feeding of the bars of the mixture to the source of energy, guide elements are advantageously used. A charge of the matter, which has been formed into a bar shape, is advisably dried. In this step a certain dimensional stability and cold-crushing strength of the bars must be attained, in view of the requirements of the forward-feed system.

In applying the method according to the invention to the processing of foundry dusts, the following procedure can, advantageously, be followed, starting, for example, with the charged matter shown in the following Table:

TABLE 1

| | Analysis of the charged matter | | | |
|---|---|---|---|---|
| | FS | KR | GS | KS |
| Fe | 46.80 | 50.35 | 27.40 | 31.70 |
| FeO | 8.90 | — | 5.16 | — |
| $Fe_2O_3$ | 57.06 | (71.98) | (38.42) | 45.33 |
| Mn | 1.21 | 0.09 | 0.57 | — |
| $SiO_2$ | 1.55 | 16.31 | 8.08 | 21.20 |
| $Al_2O_3$ | 0.33 | 3.64 | 1.93 | 8.70 |
| CaO | 15.60 | 0.13 | 6.93 | 13.02 |
| MgO | 1.75 | 0.36 | 1.73 | 0.69 |
| P | 0.064 | 0.055 | 0.050 | 0.157 |
| S | 0.072 | 0.023 | 0.42 | 3.40 |
| Pb | 0.54 | 0.001 | 0.019 | — |
| Zn | 3.18 | 0.0019 | 0.0055 | 0.018 |
| $CO_2$ | — | — | 1.13 | — |
| C | — | — | 37.31 | 79.13 |
| Cu | — | — | 0.007 | — |
| Cr | — | — | 0.02 | — |
| $TiO_2$ | 0.08 | — | 0.50 | 0.46 |
| $Na_2O$ | — | — | 0.15 | 0.46 |
| $K_2O$ | — | — | 0.29 | 0.94 |
| Moisture | 20.40 | 4.37 | — | 0.5 |
| Annealing loss | 8.40 | 2.37 | 40.60 | 1.85 |
| Ash | — | — | — | 20 |

FS filter dust
Kr Krivoj-Rog (acid ore dust)
Gs blast-furnace flue dust
KS coke ash from the coke dust (filter dust)

Mixing proportions of the foundry dusts, in % by mass:

| | |
|---|---|
| FS | 38.8 |
| KR | 25.6 |
| GS | 31.0 |
| KS | 4.6 |

-continued

| | |
|---|---|
| Total | 100.0% |

The charged matter listed in Table 1 is expediently thoroughly mixed with approximately 9% water, pressed to form bars of appropriate size and subsequently dried. The dried bars are, with the collaboration of tracers which ensure a precise advancing of the bars of mixture, arranged radially about a central source of radiation. A cavern having a defined geometry being formed about this source of radiation, for example, a plasma jet. According to an advantageous form of embodiment of the invention, the plasma jet can be designed in the manner described in Austrian Patent No. 376 702. After the ignition by means of argon gas of the plasma jet which originates from a graphite electrode, hydrocarbons and/or finely dispersed graphite are introduced with the argon into the plasma jet. As a result of the high plasma temperature, the carbon (graphite) is converted to the gaseous phase and the reduction process is accelerated by the ionization of the carbon gas. In addition, the consumption of the graphite electrodes is largely inhibited by the highly ionized carbon-gas atmosphere. After the ignition of the plasma jet between the electrodes, the bars of the mixture which surround the plasma jet cavern-like begin to melt. The bars are advanced from outside, at the same rate as they melt, with the result that the cavern geometry constantly remains the same. During the melting, the hot-chemical reaction of a direct reduction simultaneously takes place.

Since, in the present invention, this reaction takes place under the exclusion of air, only carbon monoxide and hydrogen can form as waste gases in addition to the argon plasma gas, at the prevailing high temperatures. These gases can be admitted to energy recycling using known technology.

The heavy-metal components contained in the charged matter vaporize in the process taking place and can, for the most part, be condensed in a gas hood or in condenser elements installed in the gas-vent pipe.

The liquid iron resulting from this process can be topped continuously; the accumulating slag can, likewise, be drawn off continuously.

The method according to the invention is also suitable for the processing of slurries resulting from the extraction of iron ore, for example the slurry obtained at the Erzberg in the Steirmark region of Austria. Table 2 below shows the average values of the slurry analysis of iron ore:

TABLE 2

| Iron-ore-slurry analysis* | in % |
|---|---|
| Fe | 26 |
| FeO | 14.5 |
| $Fe_2O_3$ | 20.7 |
| Annealing loss ($CO_2$ + $H_2O$ bd.) | 26.6 |
| $SiO_2$ | 12.5 |
| CaO | 13.3 |
| $Al_2O_3$ | 5.6 |
| MgO | 4.0 |
| $SO_3$ | 0.21 |
| $P_2O_5$ | 0.14 |
| Mn | 1.8 |

As shown in the Table 2, the composition of this slurry already represents a mix suitable for use on its own. After the admixture of carbon, depending on the stoichiometric requirements, this charged matter can be pressed to form appropriate bars and can be admitted to the process described above for melting reduction according to the invention. Here too, of fundamental importance for the progress of the method according to the invention is, the appropriate formation and maintenance of the cavern geometry during the entire course of the process.

All types of metal ores can be hot-chemically reduced according to the above principle. In like manner, all melting processes which are undertaken at very high temperatures can be carried out applying the method according to the invention. Of particular interest is the reprocessing of filter dusts and of slag residues from combustion plants, such as, e.g. refuse incineration plants, which can be melted down to such an extent that vaporized heavy metals can be recovered by means of partial condensation and possibly remaining trace elements can be integrated in the glass-ceramic end product, from which they can no longer be leached.

A particularly interesting application is provided by the method according to the invention for the direct reduction of bauxite to metallic aluminium. To this end, finely ground bauxite is thoroughly mixed with carbon according to the stoichiometric requirements and is pressed into appropriate bars in the manner described above, and dried. The bars are guided to the radiation source in such a way that a defined cavern geometry is provided and maintained in the course of the further reactions. After the ignition of the plasma jet, the bauxite mixture is melted away on the surface, the iron oxide first being reduced and then collecting in the collecting vessel as bog iron ore which is saturated with aluminum and enriched with carbon. The aluminum oxide is initially obtained as molten mass (mullite melt) and is then converted by means of the further supply of energy at temperatures >2000° C. according to the formula $2\ Al_2O_3+9C \rightarrow Al_4C_3+6\ CO$, (Heat of formation $\Delta H=-49.9$ kcal/mol) with $Al^{3+}$ – and $C^{4-}$ ions predominantly in aluminium carbide ($Al_4C_3$). During a slow cooling-down from 1500° C. to about 660° C., $Al_4C_3$ decomposes into metallic aluminium and carbon in the form of graphite, according to $Al_4C_3 \rightarrow 4\ Al+3C$. A conversion of the carbide with $Al_2O_3$ may also take place, possibly according to the reaction $Al_4C_3+Al_2O_3 \rightarrow 6Al+3CO$.

In order to achieve a complete conversion of the available $Al_2O_3$ or mullite melt, it is advantageous to proceed as follows:

The $Al_2O_3$, initially obtained in the form of a molten mass (mullite melt) is passed, under the effect of the hot gas formed ($CO/H_2$ gas), in the direction of a clarification vessel, forming aluminium carbide and its subsequent disproportionation. Remaining non-converted $Al_2O_3$ melt is again returned to the reaction zone, in order to achieve a complete conversion. In the region of the clarification zone, metallic aluminium having a maximum carbon content of 0.05%, a silicon content of about 1%, a titanium content of about 1% and a further iron impurity of, maximally, 1.8%, is tapped. Iron, which is saturated with aluminium and enriched with carbon, is continuously drawn off from the collecting basin provided below the reaction zone.

The plasma jet according to the present invention is kept within the cavern because, in order to make full use of the high energy density of a plasma jet, it would be necessary to support the plasma jet precisely within the defined cavern. In addition, it would be imperative for the optimization of the melting and reduction process to observe as exactly as possible the energy, that is melting enthalpy and reduction enthalpy, required to carry out the hot-chemical processes, as well as optimally adapting the gasification enthalpy of the graphite in the plasma jet to the total energy which is supplied to the plasma jet. This object is not satisfactorily achieved by the conventional plasma-jet technology. This conventional technology provides that a plasma jet is mounted between two electrodes, a top electrode and a bottom electrode, and/or between a top electrode and two or three side electrodes. In this regard, however, the plasma jet can unilaterally burn out a cavern within the furnace, since it cannot be guided in a controlled manner.

A further advantageous embodiment of the method according to the invention meets this object, i.e., to adhere accurately to the energy input and the controlled guiding of the plasma jet within the defined cavern, in that, between the principal electrode, the top electrode, which projects into the cavern, and a number of radial electrodes (a to h), which are arranged immediately below the cavern, the plasma jet is ignited. The radial electrodes are loaded, by means of thyristor control, with a basic load for the ionization of the gas atmosphere, while the main load is distributed across the thyristors via thermoelements, which are provided on the front edge of the guide system, such that the uniform melting rate within the cavern surface area is ensured.

A further advantageous form of embodiment provides that the melting stock which is collected in the collecting basin can receive an additional energy input from the radial electrodes via the bottom electrode which is energized via a bath-temperature gauge, so that the bath temperature is always kept at a constant level.

According to a further aspect, the present invention relates to apparatus to carry out the method described above, the apparatus being characterized essentially by centrally arranged, geometrically defined cavern formed by bars composed of a mixture to be melted and/or meltingly-reduced, by preferably radially-arranged tracers for the advancing of the bars of mixture towards the center, by a collecting vessels which is arranged below the cavern and which is provided with outlets for the metal melt and the liquid slag, by a central electrode arrangement, by a gas hood and by a gas-vent pipe.

BRIEF DESCRIPTION OF THE DRAWINGS

Exemplified embodiments of the apparatus according to the invention are illustrated in the attached drawings. In the drawings.

In these drawings, the cavern 1 is formed by the mixture to be melted and/or to be meltingly-reduced, which mixture is advanced in bar form radially inwards from the outside. The radially-arranged guide elements 2 ensure a precise advancing of the mixture bars towards the center. The outlets for the metal melt and for the liquid slag are provided at appropriate points in the collecting basin 3 below the cavern 1. Reference numeral 4 designates the upper electrode, the bottom electrode 10 is arranged on the floor of the collecting basin 3. Reference numeral 5 designates the upper covering of the reaction vessel, reference numerals 6 and 7 respectively represent the gas hood and the gas-vent pipe. Connecting passages are designated by reference numerals 8 and 9. In FIG. 5, the upper or top electrode 4, which projects into the cavern 1, is provided with the required power and gas supply, and can be displaced in the vertical direction by means of a sliding carriage or the like. In a horizontal plane immediately below the cavern 1 are arranged a number of radial electrodes (a to h), which can each, independently, travel forwards and backwards in the radial direction and which are preferably rotatable about the radius in question. A bottom electrode 10 may be provided in the collecting basin 3 below the cavern 1.

Figure 1:
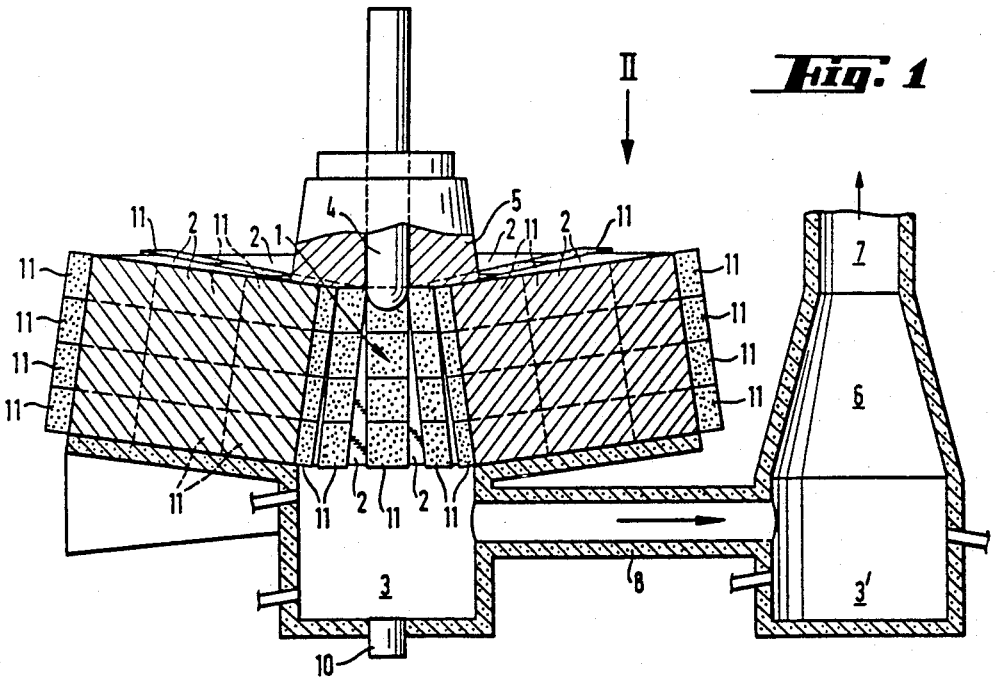
FIG. 1 shows a cross-section of an apparatus according to the invention.
Figure 2:
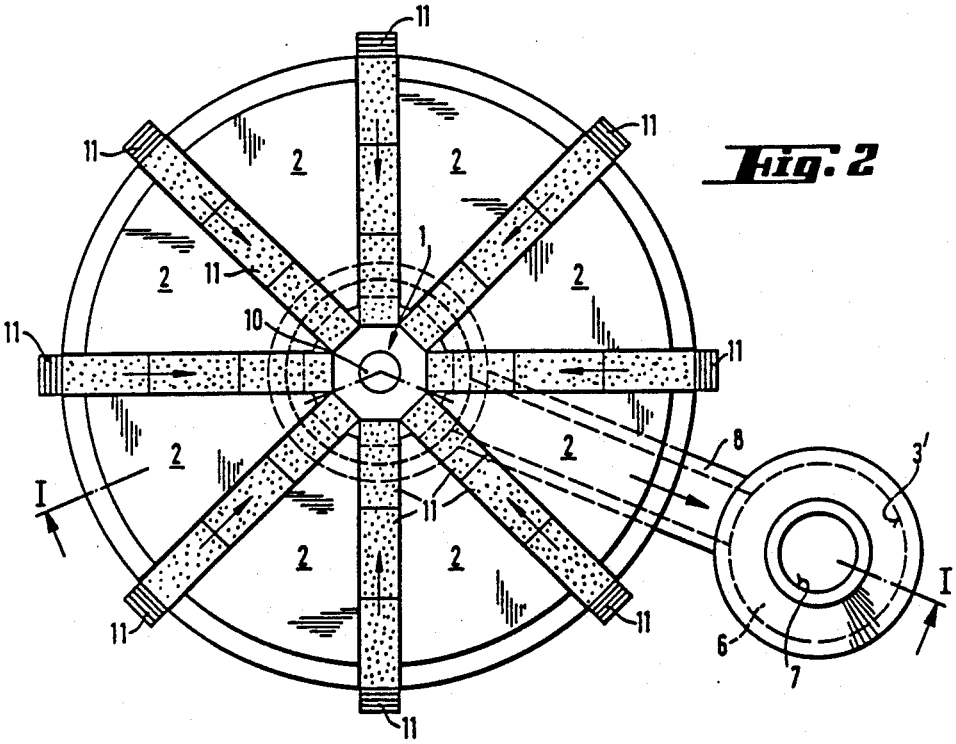
FIG. 2 shows a plan view of this apparatus.
Figure 3:
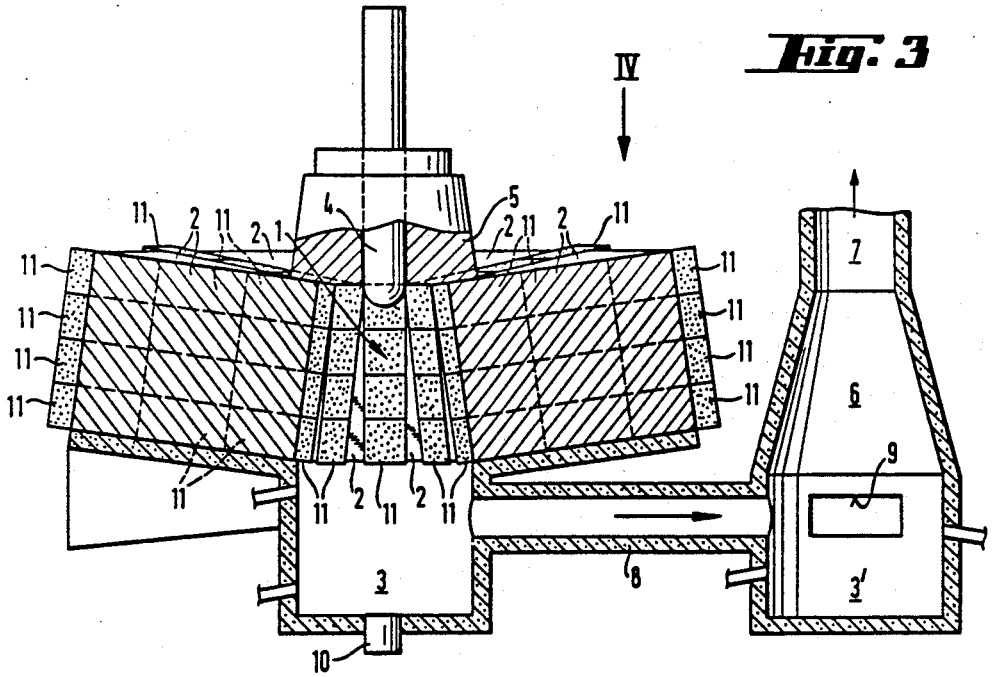
FIGS. 3 and 4 represent a cross-section and a plan view, respectively, of a second apparatus embodiment according to the invention, in particular for the direct reduction of bauxite.
Figure 4:
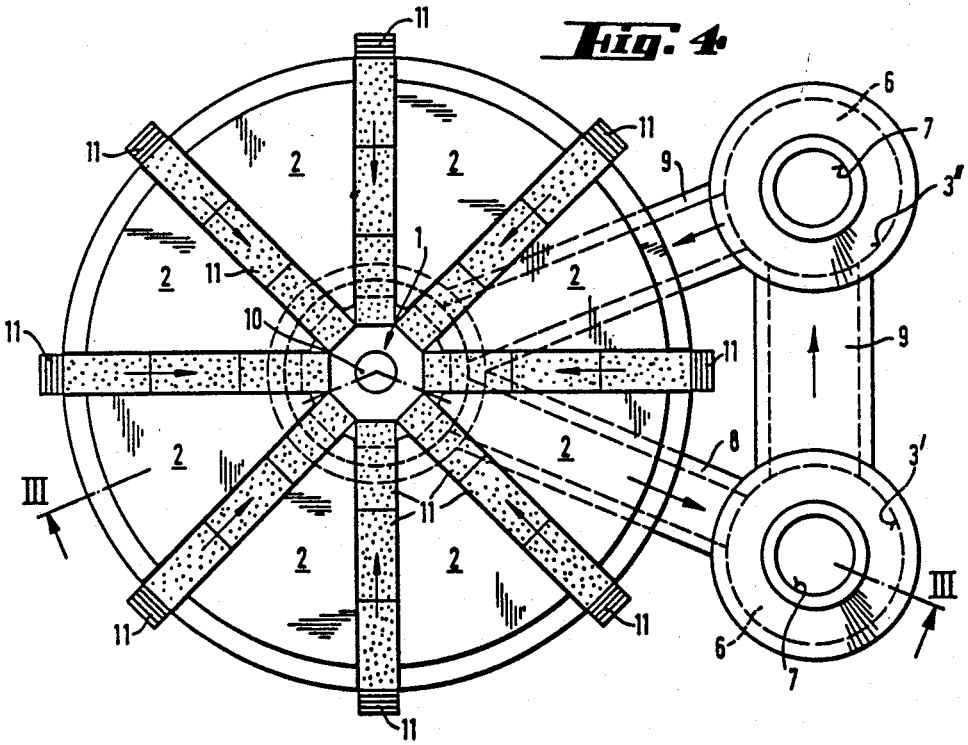
Figure 5:
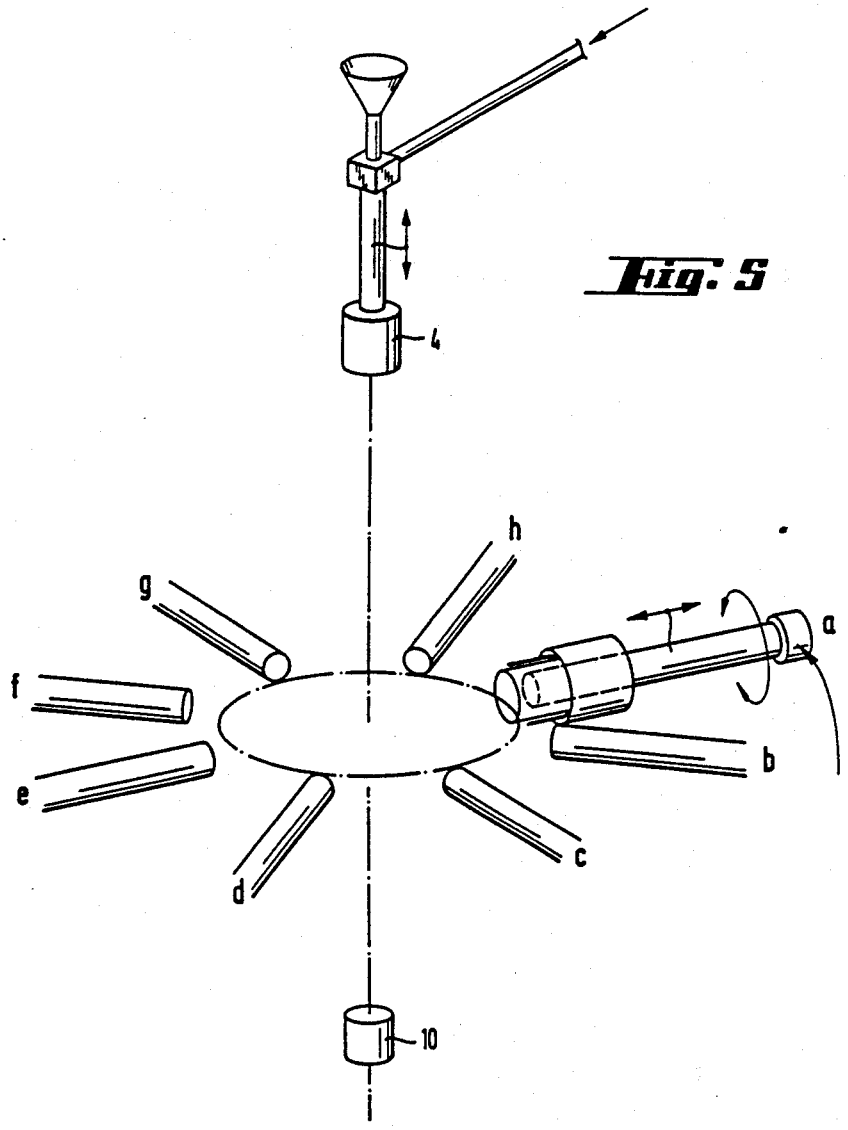
FIG. 5 shown a diagrammatic sketch of a third embodiment of the apparatus according to the invention, by means of which the energy input can be maintained accurately and the plasma jet can be controllingly guided within the defined cavern.

By carrying out the method according to the invention, the direct conversion of the oxide components of the mixture to a molten mass and the reduction to metals from the liquid phase, are made possible. The advantage of this technology, relative to the conventional process, resides in that, e.g. $Fe_2O_3$ can be reduced to Fe, not proceeding via the detour of $Fe_3O_4$ and FeO to Fe, but directly via the molten mass $Fe_2O_3$ to Fe. In this regard, it is possible to utilize the existence of a miscibility gap, where iron is obtained in pure form without carbon, silicon, manganese, phosphorus, etc. impurities, and is in an equilibrium with liquid $Fe_2O_3$, in this regard, see ULLMANNS ENCYKLOPAEDIE DER TECHNISCHEN CHEMIE, 4th Edition, Volume 10, page 334.

We claim:

1. Method for melting or melt reducing chemical mixtures at working temperatures which exceed the melting temperature of highly refractory linings, comprising the steps of pressing the chemical mixture into bars, arranging the bars to form cavern having a defined geometry, the cavern surrounding a centrally located high, energy density radiation source, a portion of the bars facing the radiation source melting at a melting rate and maintaining the cavern geometry by radially advancing the bars toward the radiation source at a rate which is the same as the melting rate.

2. Method according to claim 1, wherein the high energy density radiation source is a plasma jet.

3. Method according to claim 2, wherein the plasma jet is ignited by means of argon gas which originates from a graphite electrode, further comprising introducing at least one member of the group consisting of hydrocarbons and finely dispersed graphite with the argon gas into the plasma jet.

4. Method according to claim 1, further comprising a plurality of guide elements arranged for the precise advancing of the mixture bars.

5. Method according to claim 1, wherein the high energy density radiation source comprises a plasma jet, the plasma jet being erected between a top electrode, which projects into the cavern, and a plurality of radial electrodes, which are arranged immediately below the cavern, the radial electrodes having a first load sufficient for the ionization of the gas atmosphere, and a second load is distributed to the radial electrodes in such a way that a uniform melting rate within the cavern surface area is ensured.

6. Method according to claim 5, further comprising a bottom electrode for the stabilization of the bath temperature disposed in the collecting basin for the melting stock, the bottom electrode receiving energy input from the radial electrodes.

7. Apparatus for melting or melt reducing a chemical mixture, the chemical mixture being formed into bars, the bars being arranged to form a cavern comprising a central electrode arrangement, for generating a radiation source, a plurality of radially-arranged guide elements for advancing the bars of chemical mixture towards the radiation source, a collecting basin disposed below the cavern which is provided with outlets for the chemical melt, a covering disposed above the cavern, a gas hood and a gas-vent pipe attached thereto, for venting gases generated during the melting or melt reducing of the chemical mixture.

8. Apparatus according to claim 7, wherein the collecting basin is a first collecting basin, further comprising a second collecting basin in communication with the first collecting basin below the cavern serving as clarification zone for the melt of the chemical mixture.

9. Apparatus according to claim 7, further comprising at least one additional basin connected to the first and the second collection basins.

10. Apparatus according to claim 7, wherein the central electrode arrangement comprises a top electrode, which projects into the cavern, and a number of radial electrodes, which are arranged immediately below the cavern, the radial electrodes having a first load sufficient for the ionization of the gas atmosphere, whereby a plasma jet is established, and a second load distributed to the radial electrodes such that a uniform melting rate of the cavern surface is ensured.

11. Apparatus according to claim 7, further comprising a bottom electrode, disposed in the collecting basin for the melting stock, the bottom electrode being supplied with an energy input from the radial electrodes for the stabilization of the bath temperature.

12. Method according to claim 1, wherein the chemical mixture is a member of the group consisting of foundry dust, slag residues, and ores.

13. Method according to claim 1, wherein the chemical mixture includes a member of the group consisting of Si, $SiO_2$, Mg, MgO, Ti, $TiO_2$, Ta, and $Ta_2O_5$.

14. Method according to claim 4, wherein the bars include a tracer thereby facilitating the precise advancing of the mixture bars.

15. Method according to claim 1, wherein the chemical mixture is bauxite, further comprising, prior to the step of pressing the chemical mixture, the steps of:

grinding the bauxite to form powdered bauxite; and mixing the powdered bauxite with an effective amount of carbon, to form the chemical mixture;

and wherein the portion of the bars which melts contains $Al_2O_3$, and CO and $H_2$ are liberated;

and after the step of maintaining the cavern geometry by radially advancing the bars, passing the $Al_2O_3$, CO and $H_2$ to a clarification zone, at a temperature greater than 2000° C., whereby $Al_4C_3$ is formed and a portion of the $Al_2O_3$ remains; and cooling the $Al_4C_3$ with the remaining $Al_2O_3$ in a slow controlled fashion to at least 660° C. to form Al.

16. Method according to claim 15, further comprising returning the remaining $Al_2O_3$ to the clarification zone.

* * * * *

UNITED STATES PATENT AND TRADEMARK OFFICE

CERTIFICATE OF CORRECTION

PATENT NO. : 4,985,067

DATED : January 15th, 1991

INVENTOR(S) : Wilhelm STADLBAUER et al.

It is certified that error appears in the above-identified patent and that said Letters Patent is hereby corrected as shown below:

On the title page, under item [73], in the second line, "Verwetung" should read --Verwertung--.

Signed and Sealed this

Twenty-first Day of April, 1992

*Attest:*

HARRY F. MANBECK, JR.

*Attesting Officer*

*Commissioner of Patents and Trademarks*